United States Patent [19]

Shepherd et al.

[11] 4,174,598

[45] Nov. 20, 1979

[54] METHOD FOR MAKING A PACKAGED GEL REFRIGERANT

[75] Inventors: Patrick J. Shepherd, P.O. Box 328, Lodi, Calif. 95240; David L. Hubble, Sr., Lodi, Calif.

[73] Assignee: Patrick Joseph Shepherd, Lodi, Calif.

[21] Appl. No.: 908,977

[22] Filed: May 24, 1978

[51] Int. Cl.[2] ..... B65B 3/12; B65B 3/02; F25D 3/08

[52] U.S. Cl. ..... 53/431; 53/452; 53/468; 53/469; 53/474; 53/477; 62/530

[58] Field of Search ..... 53/431, 433, 437, 440, 53/452, 468, 469, 477, 474; 62/530; 206/219

[56] References Cited

U.S. PATENT DOCUMENTS

| | | | |
|---|---|---|---|
| 2,203,591 | 6/1940 | Brown | 62/530 |
| 2,613,487 | 10/1952 | Vaughn | 53/431 |
| 2,803,115 | 8/1957 | Shepherd | 62/530 |
| 2,863,305 | 12/1958 | Shepherd | 62/530 |
| 3,456,861 | 7/1969 | Wettlen | 53/452 X |
| 3,561,186 | 2/1971 | Pickering | 53/469 X |
| 3,715,855 | 2/1973 | Armstrong | 53/477 X |
| 3,885,403 | 5/1975 | Spencer | 62/530 |

*Primary Examiner*—Horace M. Culver
*Attorney, Agent, or Firm*—Owen, Wickersham & Erickson

[57] ABSTRACT

A method for making packaged gel refrigerant. Polyethylene tubing having a gusset fold along each side edge is cut off in desired lengths and one end of each is heat-sealed. A metered amount of dry, powdered gel base is inserted, and the other end of the bag is then heat-sealed to provide a closed and sealed bag containing the gel base. The bags may then be shipped to a remote location. There a hollow needle is moved to pierce the bag contents through the gusset fold and next to an upper sealed end, the cut leaving a small plastic flap still attached to the bag. A jet of a metered amount of water under high pressure is then sent through the needle to combine with the powder in the lower part of the bag, and then the needle is removed, the cut flap closing most of the needle-entry opening. The water and powder are then mixed together away from that opening, the freshly formed and still forming flexible gel being thereafter distributed substantially evenly throughout the bag.

7 Claims, 8 Drawing Figures

METHOD FOR MAKING A PACKAGED GEL REFRIGERANT

BACKGROUND OF THE INVENTION

This invention relates to a method for making a packaged gel refrigerant.

Packaged gel refrigerants have been about for some years, and a good method of making them and a good type of product is shown in U.S. Pat. No. 2,863,305 to John C. Shepherd.

However, the product shown in the Shepherd patent has not satisfied some users because they do not wish to require their workers to follow the fairly simple directions on that package and because the workers are not always sufficiently adept. Some workers are sloppy and tend to spill water, and even sometimes spill out the gel or gel base when attempting to practice that process.

The process usually practised with the Shepherd U.S. Pat. No. 2,863,305 called for one end of the bag to be open and for one man to hold the bag while another one poured the water in. After the needed amount of water has been poured in, as indicated by the markers on the bag, the bag is then twisted and shaken, air is removed, and the product is formed to a desired shape and then sealed with a strip wire tie.

Another problem with which the present invention is concerned is that of enabling a user of packaged gel refrigerant to have the gel base (the solid material which is to be mixed with about four to nine times its own weight of water), packaged in one location and then shipped to the location of use, thereby enabling the user to add the water at that location, but to do so without risk of spillage of the materials from the bag. The Shepherd U.S. Pat. No. 2,863,305 does show one way of doing this, but many users have been skeptical of it since the bag is still basically open at one end.

One purpose of the present invention is to provide a system by which the gel base can be shipped dry in a completely sealed bag, and that same bag can later be used for containing the gel refrigerant. The invention includes a system for adding water to an already sealed bag of this kind.

There are several advantages to shipping the bag or product in the powdered form, the most apparent being the savings in shipment costs which result from the fact that from 50–90% of the eventual gel refrigerant is water, and when only the gel base is shipped, the cost of shipping water is saved. An additional advantage arises from the fact that when the product as shipped comprises bags of water-containing gel, the gel is not rigid enough to offer support when shipped in cases stacked more than two and three high without rupturing the bags in the bottom row of cases, thereby causing seepage of gel. As a result, the capabilities of the gel refrigerant industry have hitherto been limited. A third advantage is the freshness of the gel refrigerant when it is made shortly before use.

In addition to what has already been pointed out, other objects and advantages of the invention will become apparent when considering the invention in detail.

SUMMARY OF THE INVENTION

Predetermined lengths of polyethylene gusseted tubing having a gusset fold along each side edge are cut, each length having two open ends. One end is then heat-sealed by melting and congealing together four thicknesses at each of the two gusseted portions at that end, and melting and congealing together two thicknesses in between the gusseted portions. The result is an open-end bag.

Into this open-end bag is inserted a metered amount of gel base, comprising a dry solid mixture of finely powdered materials. Then the open end is sealed as was the other end, to provide a closed and sealed bag containing the dry finely-powdered gel base. These sealed bags may then be shipped to a remote location, the shipping weight being only a small fraction of that of the ultimate gel refrigerant.

At the remote location or at any location, the activation of the product begins by forcing a hollow needle having a sharp inclined cutting end through each bag adjacent one sealed end, the bag being held so that its contents lie below the needle-entry location. The needle is forced through the gusset fold at a locus next to the upper sealed end, preferably so that it cuts through the bag but leaves a small plastic flap still attached to the bag, the needle temporarily forcing the flap to one side of the resultant opening. Next, a jet of a metered amount of water under high pressure is sent downwardly through the needle opening into said bag. The needle is then removed from the bag, and the cut flap is caused by the gusset-fold to close most of the needle-made opening. The water and powder are mixed together almost instantaneously while kept away from that opening, contact being provided between all of the gel base and the water, and a flexible gel forms at once. The freshly formed and still forming flexible gel may easily be distributed substantially evenly throughout the bag, the gel holding the water and holding itself together to prevent leakage or seepage out through the flap-blocked opening formed by the needle. Thereafter, the bag can be used in any position and can withstand substantial pressure thereon, as in being molded to a shape, without leakage of gel or water from the bag.

DETAILED DESCRIPTION OF THE INVENTION

Figures 1, 2, 3:
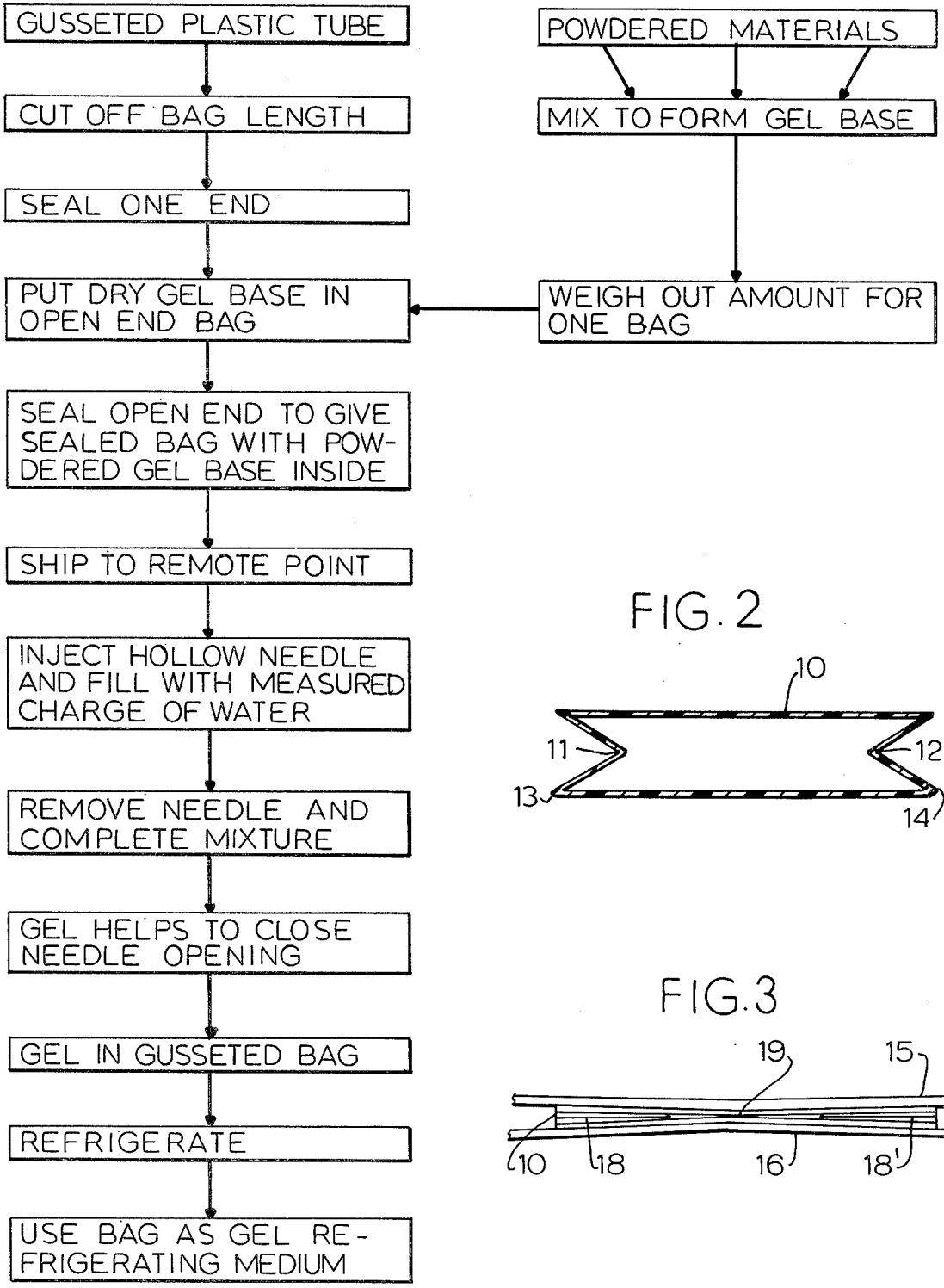
FIG. 1 is a flow sheet of a process embodying the principles of the invention.
FIG. 2 is a view in cross-section of an open gusseted plastic bag or strip.
FIG. 3 is a similar view of one end of a gusseted bag or strip between two bands of a band sealer.

An important feature of the present invention is the use of gusseted bags. I have found that the gusseted bags enable the use of a piercing needle to supply water to the bags, and the gussets help to protect the bag from water leaking out or gel being forced out after the gel has formed. The gusseted bags also can seal the needle hole and enable an increased thickness of the final product.

The best material for use in this invention appears to be polyethylene in the form of gusseted polyethylene tubing 10 (FIG. 2) with two gusseted portions 11 and 12, one at each side, making a gusset fold along each side edge 13 or 14. Such tubing 10 may be bought in bulk and cut to any desired length as part of this process (See FIG. 1) or the user may purchase cut-off lengths of such gusseted tubing. If one has a cutter that is suitable, there are advantages to the one practicing the invention doing his own cutting. The bags usable in the present invention are not large, with the maximum size weighing about four pounds when filled with gelled refrigerant, and the minimum size weighing about one-half pound. The bags are typically cut from gusseted polyethylene that is four and one-half inches wide with the gussets folded in. The gussets may be enough to make an eventual expanded bag thickness of about one or two inches, depending upon the size desired. The length of the cut-off portion in these events will vary from about four inches to about twelve inches. Thus, an eight-ounce bag may be 4½"×4½"×1"; a 16-ounce bag may be 7½"×4½"×1"; a 24-ounce bag may be 6½"×4½"×2"; a 32-ounce bag may be 7½"×4½"×2"; and a 48-ounce bag may be 12"×4½"×2". It is possible to make a 68-ounce bag about 14½" or 15"×4½"×2". Beyond this, the bag tends to be too long to get good mixing for quality product, and it becomes more difficult to handle the machine. Preferably, 4-mil polyethylene is used, and it should be kept within a range of about 2–5 mils thick.

Heretofore, gusseted bags have not been used in packaging dry powdered gel refrigerant bases, and their use in this invention gave rise to some additional problems, though it was found that without using the gusseted bag, a satisfactory product was difficult to make and was not uniformly attainable under present manufacturing conditions. One additional problem was that the sealing of polyethylene bags is best done by a heat seal, and it is difficult to get a heat seal that on the one hand assures the welding together of all four thicknesses in the gusseted portions, while also being satisfactory for the double thickness of the portion in between the gusseted portions. With most types of sealing machines, if the temperature was right for sealing the two-thickness portion, then the gusseted portions were not sealed together properly and the bag leaked; however, when the gusseted portions were properly sealed, the in-between portions tended to be burned away so that leakage resulted there.

However, it has been found that by using a band sealer, this problem can be overcome. A band sealer usable in this invention may comprise two pairs of reeled bands 15 and 16 which unreel over a given length and carry one end of the bag into rubbing contact with a hot member 17, such as a Calrod or infrared heating element. For example, such a heating element 17 may be about 30-inches long, and by exposing one end of gusseted polyethylene 10 of 4-mil thickness to this Calrod or infrared heater 17 at a temperature in the neighborhood of 500°–750° F. for approximately a 5-second rubbing contact, a suitable seal may be made that secures both the four-thickness portions 18, 18' and two-thickness portion 19 together quite satisfactorily. There is no burning of the two-thickness portions in between the gussets, so that sealing is satisfactory over the complete end of the bag. Thus, the proper type of heat-sealing calls for melting and congealing together four thicknesses at each of the two gusseted portions at the end being sealed, and melting and congealing together two thicknesses in between the gusseted portions. The apparatus and process just described does that.

Thus, after the desired length of gusseted tubing has been cut off, it is then heat-sealed at one end 20 to make an open-end bag 21, as shown in FIG. 1. After the heat-sealing is completed, a metered amount of the gel base 22 is dispensed into the bag. In other words, a dry, solid mixture of finely powdered material comprising the gel base, is placed into the bag 21. At this point it would be noted that for the method of the present invention, it is better (and with some chemicals or with chemicals from some manufacturers, quite important) to use powder rather than granular materials. The granular materials do not, in some instances, accept water fast enough and do not mix well enough with the other materials. Finely powdered materials, as distinct from granular materials, are, of course, easily obtainable from the manufacturers by asking for them. Thus, with borax, granular borax may mean that 90% passes through 120 mesh, while with powdered borax, 98% passes through 200 mesh.

The same mixtures named in the Shepherd U.S. Pat. No. 2,863,305 patent can be used. I have found that there are several types of gel mixtures, each of which may be preferable for certain circumstances. For example, some products should be kept at different basic temperatures than others, and it helps to have a gel which freezes at a desired temperature. Some examples of suitable gels are as follows.

EXAMPLE 1

| | |
|---|---|
| Pregelatinized corn starch | 100 parts by weight |
| Powdered 10-mol borax | 25 parts by weight |
| Paraformaldehyde | 2 parts by weight |

In addition to these essential ingredients, a standard coloring or dye can be used to identify the particular kind or manufacturer of product. Thus, a blue-dyed product might have a freezing point of 30°. When water is eventually added, the normal dilution is 7.8 parts of water per part of this dry product.

EXAMPLE 2

For a one-use product the formula of Example 1 may be modified by reducing the borax to about 16% and the paraformaldehyde to about ½ of 1%. With this product, the ultimate dilution would be one part of the dry composition to 9 parts of water.

EXAMPLE 3

A product which freezes at about 10° F. may be made by changing the formula of Example 1 only insofar as the amount of potassium chloride is concerned, using about 7 parts. Preferably, less water is used in the ultimate dilution.

EXAMPLE 4

A product which freezes at about −10° F. may be like that of Example 3 with still less water, about a four-to-one dilution.

Figure 4:
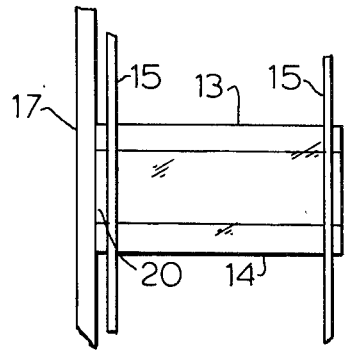
FIG. 4 is a top plan view of a portion of a band sealer with one end of a bag rubbing against a hot rod.

With a metered amount of such a dry composition 22 placed inside the bag 21, the actual amount depending on the size of the bag 21 and the ultimate amount of water to be used, the bag 21 is then sealed and closed, as by passing its other end 23 through a band-type heat sealer (FIGS. 3 and 4), so that the bag 21 is completely sealed and closed with the dry powder 22 inside.

The sealed bags are then packed in corrugated containers and shipped, with the gel base in powder form to a receiving point. This may be quite remote from the point of manufacture.

At the receiving point and at such time as the receiver desires, water is injected into the individual bag, and the powder is turned into a gel, as stated in FIG. 1. Preferably this is done by using a combination of a piston filler 25 to meter correct amounts of the water and an injection needle 26 to pierce the bag with a very small opening.

Figure 5:
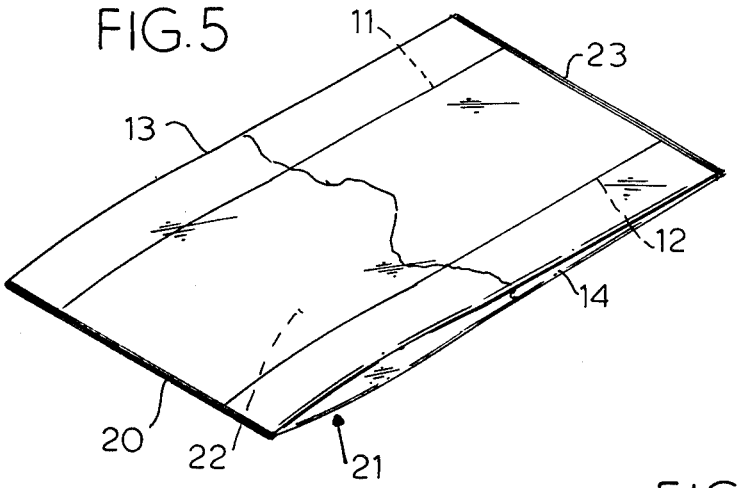
FIG. 5 is a view in perspective of a sealed bag containing dry powdered gel base, according to the principles of this invention.
Figure 6:
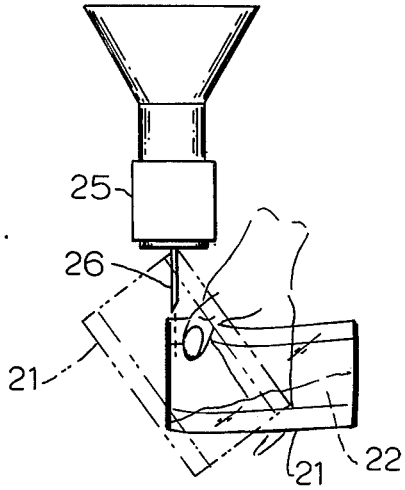
FIG. 6 is a view showing a water supplying needle being inserted into a bag like that of FIG. 5. In broken lines, the position of the bag during injection of the water is shown.
Figure 7:
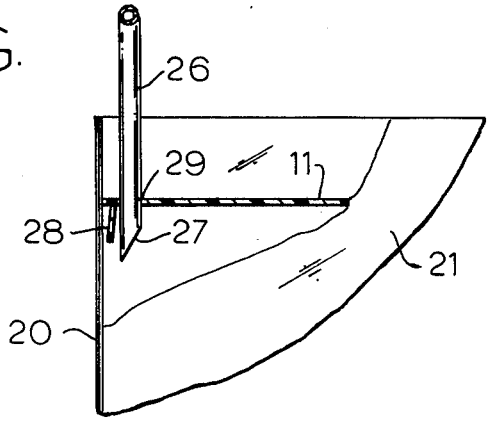
FIG. 7 is an enlarged fragmentary view of a portion of FIG. 6.
Figure 8:
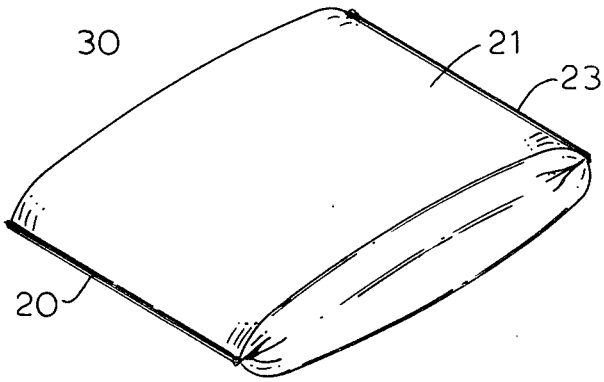
FIG. 8 is a view in perspective of the bag of FIGS. 5–7 after the water has been injected and the gel refrigerant formed.

The hollow tubular needle 26 should be as small as is feasible but large enough so that it can be operated without breaking. The piston filler 25 ejects water under pressure, and the pressure is important in securing a good mixing of the products. In order to avoid spillage, the needle 26 may be moved down from above or from one side or at an angle, to pierce a sealed bag 21 that is held adjacent the needle 26. The bag 21 is held so that its contents 22 lie below the place where the needle 26 enters, and the needle 26 is forced through a gusset fold 11 at a locus next to one sealed end 20 or 23. By using a needle 26 with a slanted sharp end 27, it is both feasible and desirable to cut through the gusset fold 11 in such a way as to leave a small plastic flap 28 still attached to the bag 21. The needle 26 temporarily forces the flap 28 to one side during the filling operation. A jet of a metered amount of water under high pressure is then sent through the needle 26 and into the bag 21. The amount of water injected depends upon the ultimate composition of the gel. Injection can be done very quickly at high pressure, a matter of a second or two, or even less. The bag being held initially in the position shown in solid lines in FIG. 6 to start the needle 26 in and then dropped to the position shown in broken lines in FIG. 5, the dry composition 22 is in a good position to receive the water and to accept it readily with the water plowing its way through to the product. An example of a desirable pressure at the needle is 125–150 p.s.i. As soon as the water has been forced through, the needle 26 is removed and the cut flap 28 is caused by the gusset fold 11 to close most of the needle entry opening 29.

The water and powder may, if needed, be further mixed together by hand. A minimum of hand work is required, usually only a second or two at most, while holding the bag upright, to keep water from flowing out through the opening at this stage. As soon as the gel is formed, there is no danger of water flowing out. In fact, in a very few seconds the product 30 may be laid horizontally. In combination with the mixture and in the same one- or two-second operation, the operator distributes the freshly formed and still-forming flexible gel substantially evenly throughout the bag. When the gel bags are stored horizontally, their own weight helps to even them out, especially when other bags are added on top of them. As soon as the gel state is achieved, which takes a very short time, the gel not only holds its water and helps to prevent leakage of the water, but also holds itself together so that the gel itself does not tend to leak out through the flap-blocked opening. Both the state of the gel and the partial closure of the opening by the flap help to achieve this desired result, and the location of the opening in the gusset flap also is significant. Once the gel has been formed, it enables the use of the bag 21 in any position, and in fact, the bag can withstand a substantial pressure thereon, for example, in being molded to shape without the leakage of gel or water from the bag.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A method for making packaged gel refrigerant, including in combination the following sequential steps:

(a) cutting off predetermined lengths of polyethylene gusseted tubing having a gusset fold along each side edge, so that there are two open ends of each cut-off length, (b) heat-sealing one end of each cut-off length, by melting and congealing together four thicknesses at each of the two gusseted portions at that end and melting and congealing together two thicknesses in between the gusseted portions, thereby forming an open-end bag, (c) inserting into the open-end bag a metered amount of gel base comprising a dry solid mixture of finely powdered materials, said metered amount being only about one-fifth to one-tenth of the weight of the ultimate gel refrigerant, (d) heat-sealing the open end of said open-end bag, as in step (b), to provide a closed and sealed bag containing the dry finely-powdered gel base, (e) shipping the bags from step (d) to a remote location, so that the shipping weight is only about one-fifth to one-tenth that of the ultimate gel refrigerant, (f) at said remote location, forcing a hollow needle having a sharp inclined cutting end through a said bag adjacent one sealed end, the bag being held so that its contents lie below the needle-entry location, said needle being forced through the gusset fold at a locus next to said one sealed end so that it cuts through the bag but leaves a small plastic flap still attached to the bag, said needle temporarily forcing said flap to one side of the resultant opening, (g) sending through said needle and said opening and downwardly into said bag, a jet of a metered amount of water under high pressure, said metered amount having a weight approximately four to nine times the weight of said gel base in said bag, (h) removing the needle from the bag so that the cut flap is caused by the gusset-fold to close most of said opening, (i) mixing the water and powder together while keeping them away from said opening, so that contact is assured between all of said gel base and said water, and a flexible gel begins to form, and (j) distributing the freshly formed and still forming flexible gel substantially evenly throughout said bag, said gel holding the water and holding itself together to prevent leakage or seepage out through the flap-blocked opening formed by the needle, so that the bag can be used thereafter in any position and can withstand substantial pressure thereon as in being molded to a shape, without leakage of gel or water from said bag.

2. The method of claim 1 wherein said polyethylene is 2–5 mils thick.

3. A method for making packaged gel refrigerant, including in combination the following sequential steps:

(a) heat-sealing one end of a sheet of polyethylene gusseted tubing having a gusset fold along each side edge, by melting and congealing together four thicknesses at each of the two gusseted portions at that end and melting and congealing together two thicknesses in between the gusseted portions, thereby forming an open-end bag, (b) inserting into the open-end bag a metered amount of gel base comprising a dry solid mixture of finely powdered materials, (c) heat-sealing the open end of said open-end bag, as in step (a), to provide a closed and sealed bag containing the dry finely-powdered gel base, (d) shipping the bags from step (c) to a remote location, so taht the shipping weight is only a fraction of that of the ultimate gel refrigerant, (e) at said remote location, forcing a hollow needle having a sharp inclined cutting end through a said bag adjacent one sealed end, the bag being held so that its contents lie below the needle-entry location, said needle being forced through the gusset fold at a locus next to said one sealed end so that it cuts through the bag but leaves a small plastic flap still attached to the bag, said needle temporarily forcing said flap to one side of the resultant opening, (f) sending through said needle and said opening and downwardly into said bag, a jet of a metered amount of water under high pressure, (g) removing the needle from the bag so that the cut flap is caused by the gusset fold to close most of said opening, (h) mixing the water and powder together and kneading them, while keeping them away from said opening, so that contact is assured between all of said gel base and said water, and a flexible gel begins to form, and (i) distributing the freshly formed and still forming flexible gel substantially evenly throughout said bag, said gel holding the water and holding itself together to prevent leakage or seepage out through the flap-blocked opening formed by the needle.

4. A method for making packaged gel refrigerant, including in combination the following sequential steps:

(a) heat-sealing one of two open ends of a sheet of polyethylene gusseted tubing having a gusset fold along each side edge, thereby forming an open-end bag, (b) inserting into the open-end bag a metered amount of gel base comprising a dry solid mixture of finely powdered materials, (c) heat-sealing the open end of said open-end bag to provide a closed and sealed bag containing the dry finely-powdered gel base, (d) forcing a hollow needle having a sharp cutting end through a said bag adjacent one sealed end, the bag being held so that its contents lie below the needle-entry location, said needle being forced through the gusset fold, (e) sending through said needle and said opening and downwardly into said bag, a jet of a metered amount of water under high pressure, (f) removing the needle from the bag, (g) mixing the water and powder together while keeping them away from said opening, so that contact is assured between all of said gel base and said water, and a flexible gel begins to form, and (h) distributing the freshly formed and still forming flexible gel substantially evenly throughout said bag, said gel holding the water and holding itself together to prevent leakage or seepage out through the opening formed by the needle.

5. The method of claim 4 where there is the step of shipping the bags from step (c) to a remote location, so that the shipping weight is only a small fraction of the ultimate gel refrigerant, and then performing steps (d) through (h).

6. A method of making packaged gel refrigerant, employing a closed and sealed gusseted polyethylene bag containing a dry gel base comprising a dry solid mixture of finely powdered materials, including in combination the following sequential steps:

(a) forcing a hollow needle having a sharp cutting end through a said bag adjacent one sealed end, the bag being held so that its contents lie below the needle-entry location, said needle being forced through the gusset fold, (b) sending through said needle and said opening and downwardly into said bag, a jet of a metered amount of water under high pressure, (c) removing the needle from the bag, (d) mixing the water and powder together while keeping them away from said opening, so that contact is assured between all of said gel base and said water, and a flexible gel begins to form, and (e) distributing the freshly formed and still forming flexible gel substantially evenly throughout said bag, said gel holding the water and holding itself together to prevent leakage or seepage out through the opening formed by the needle.

7. A method for making packaged gel refrigerant, including in combination the following sequential steps:

(a) providing a closed and sealed gusseted polyethylene bag containing a dry gel base comprising a dry solid mixture of finely powdered materials, (b) forcing a hollow needle having a sharp inclined cutting end through a said bag adjacent one sealed end, the bag being held so that its contents lie below the needle-entry location, said needle being forced through the gusset fold at a locus next to said one sealed end so that it cuts through the bag but leaves a small plastic flap still attached to the bag, said needle temporarily forcing said flap to one side of the resultant opening, (c) sending through said needle and said opening and downwardly into said bag, a jet of a metered amount of water under high pressure, (d) removing the needle from the bag so that the cut flap is caused by the gusset fold to close most of said opening, (e) mixing the water and powder together while keeping them away from said opening, so that contact is assured between all of said gel base and said water, and a flexible gel begins to form, and (f) distributing the freshly formed and still forming flexible gel substantially evenly throughout said bag, said gel holding the water and holding itself together to prevent leakage or seepage out through the flap-blocked opening formed by the needle.

* * * * *